United States Patent [19]

Deal et al.

[11] Patent Number: 5,019,745

[45] Date of Patent: May 28, 1991

[54] UV-CURABLE ADHESIVE ATTACHMENT MEANS AND METHOD FOR A CATHODE-RAY TUBE-YOKE COMBINATION

[75] Inventors: Samuel B. Deal, Lancaster; Donald W. Bartch, Wrightsville, both of Pa.

[73] Assignee: RCA Licensing Corp., Princeton, N.J.

[21] Appl. No.: 397,933

[22] Filed: Aug. 24, 1989

[51] Int. Cl.[5] ..... H01J 29/70; H01J 9/00

[52] U.S. Cl. ..... 313/440; 156/275.5; 335/210; 358/248; 445/23

[58] Field of Search ..... 313/440; 156/275.5, 156/290, 329; 335/210, 212; 358/248; 445/23, 34, 36

[56] References Cited

U.S. PATENT DOCUMENTS

| | | | |
|---|---|---|---|
| 3,566,321 | 2/1971 | Brown, Jr. | 335/210 |
| 3,623,867 | 11/1971 | Saulnier | 96/36.1 |
| 3,981,729 | 9/1976 | Saulnier | 96/36.1 |
| 3,982,185 | 9/1976 | Shinn et al. | 339/144 |
| 4,360,839 | 11/1982 | Ragland, Jr. | 358/249 |
| 4,616,265 | 10/1986 | Lyden | 358/248 |
| 4,712,867 | 12/1987 | Malek | 350/103 |
| 4,786,973 | 11/1988 | Lock et al. | 358/248 |

OTHER PUBLICATIONS

UVEXS product bulletin, High Intensity UV Spot Cure System Model SCU 110, 12/88.

NUVA-SIL 83 technical data sheet, Nov. 1987.

*Primary Examiner*—Kenneth Wieder

*Attorney, Agent, or Firm*—Joseph S. Tripoli; Dennis H. Irlbeck; Vincent J. Coughlin, Jr.

[57] ABSTRACT

A cathode-ray tube-yoke combination comprises a cathode-ray tube having a glass envelope and a yoke fixedly positioned on the envelope with a body of cured polymeric material. The novel composition of the polymeric material comprises a UV-curable adhesive and UV-transmissive particles of a suitable material in an amount sufficient to accelerate the curing of the adhesive. A method to accelerate the curing is also described.

11 Claims, 1 Drawing Sheet

UV-CURABLE ADHESIVE ATTACHMENT MEANS AND METHOD FOR A CATHODE-RAY TUBE-YOKE COMBINATION

The present invention relates to a cathode-ray tube-yoke combination, and particularly to a cathode-ray tube (CRT) having an external, deflection yoke attached thereto by a novel composition and to an attachment method employing a UV-curable adhesive having UV-transmissive particles therein to accelerate curing of the adhesive.

BACKGROUND OF THE INVENTION

The construction of a deflection yoke and its placement on a CRT are subject to critical specifications and tolerances in order to meet the operating requirements and performance standards of the resultant video apparatus, such as a television receiver or a computer monitor. The placement and alignment of the deflection yoke on the CRT of the video apparatus is determined by adjusting the position of the yoke to optimize several performance parameters, including color purity and convergence. Once the desired yoke position is attained, the yoke must be attached to the CRT in a manner that maintains the position of the yoke after the yoke holding and adjusting fixture is removed.

A typical yoke-to-CRT attachment arrangement includes a clamp near the rear of the yoke to fix its longitudinal position on the CRT neck. The front of the yoke is then adjusted, by tilting, to optimize, for example, electron beam convergence at the edges of the CRT display screen. The front of the yoke is then fixed relative to the CRT, preferably by an adhesive. Such an arrangement is described in T.B. Lyden U.S. Pat. No. 4,616,265, issued Oct. 7, 1986. The patented yoke attachment arrangement described therein utilizes two adhesives having different hardening rates. Each adhesive comprises a multi-component adhesive system. Adhesives identified as epoxies, polyurethanes, polyesters, or acrylics have been used. The first adhesive temporarily holds the yoke to the tube and the second adhesive, having a hardening rate slower than the first adhesive, combines with the first adhesive to permanently bond the yoke to the tube. It has been determined that the adhesives utilized in the above-referenced patent may place undesirable stresses on the CRT glass due to differences in the thermal expansion properties of the glass and the adhesive. Additionally, the types of adhesives identified in the patent are rigid when cured and transmit any mechanical shock directly to the glass of the CRT. Removal of the deflection yoke also may be difficult if replacement or repair of the deflection yoke is required, because the rigid adhesives aggressively bond to the glass and cause the glass to spall during yoke removal. The use of flexible adhesives such as silicone adhesives has been impractical, because of the very slow cure rate of such materials.

B.E. Lock et al. U.S. Pat. No. 4,786,973, issued on Nov. 22, 1988 to overcomes the problem of direct attachment of the yoke to the CRT by introducing a flexible mounting sleeve between the yoke and the CRT. The sleeve is removably attached to the tube and closely conforms to the tube contour. The yoke is then adhesively mounted in the sleeve to permit removal or replacement of the deflection yoke without causing damage to the tube. A drawback of the flexible sleeve is that the sleeve and its attachment to the tube increase both the material and manufacturing costs of the yoke-tube combination.

Thus, a need exists for an adhesive composition for direct attachment of the yoke to the tube that will cure quickly, remain sufficiently flexible upon curing to prevent damage to the glass envelope of the tube, and permit removal or replacement of the deflection yoke.

SUMMARY OF THE INVENTION

A cathode-ray tube-yoke combination comprises a cathode-ray tube having a glass envelope and a yoke fixedly positioned on the envelope with a body of cured polymeric material. The novel composition of the polymeric material comprises a UV-curable adhesive and UV-transmissive particles of a suitable material in an amount sufficient to accelerate the curing of the adhesive.

DETAILED DESCRIPTION OF THE PREFERRED EMBODIMENT

Figure 1:
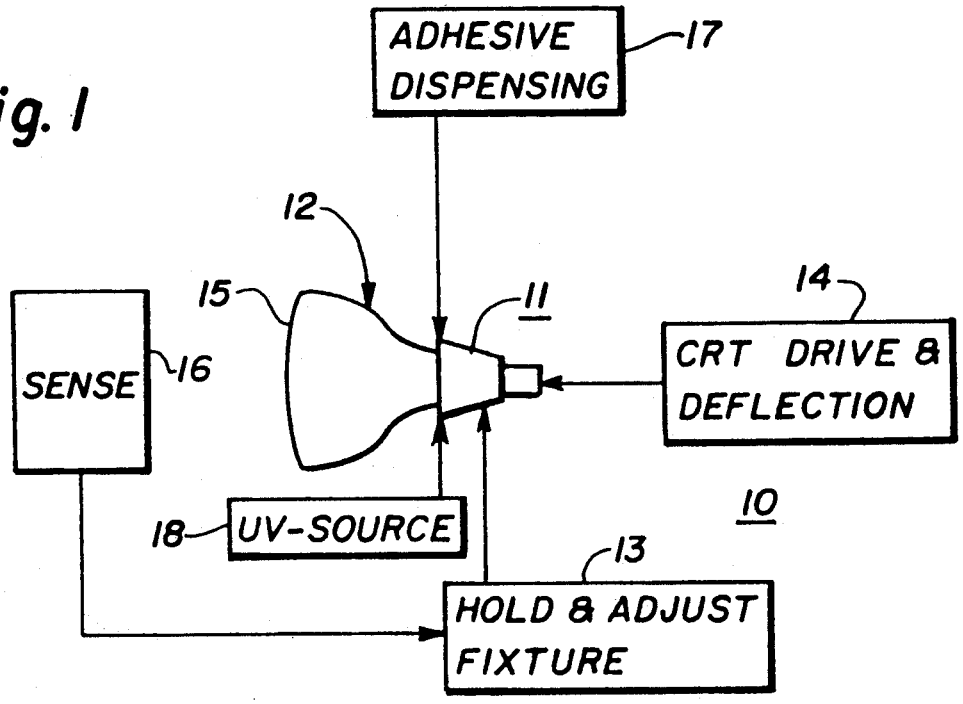
FIG. 1 is a block and schematic diagram of a video display system adjustment and assembly arrangement.

Referring to FIG. 1, there is shown a video display system adjustment and assembly arrangement 10 in which a deflection yoke 11 is disposed on the neck of a CRT 12. The position of the deflection yoke 11 relative to the CRT 12 is controlled by a holding and adjustment fixture 13. Fixture 13 may be of a type that positions a previously assembled deflection yoke onto a production CRT to form a completed yoke-tube assembly, or a type that positions the individual coils and core of a deflection yoke with respect to a "standard" CRT having predetermined, compensated errors in order to form an assembled deflection yoke that can later be positioned on a production tube. Fixture 13 also may be of a type illustratively shown in Ragland et al. U.S. Pat. No. 4,360,839, issued Nov. 23, 1982, wherein the positions of the horizontal and vertical deflection coils with respect to each other and to the CRT are independently adjusted to form a yoke-tube assembly.

The CRT 12 is energized by the cathode-ray tube drive and deflection circuitry 14, which energizes and deflects one or more of the CRT electron beams to form a raster on the CRT display screen 15 that aids in adjustment and proper positioning of the deflection yoke 11. Sensing circuitry 16, which may, for example, incorporate a video camera or a plurality of photodiodes, determines the amount of electron beam landing error of a given type, e.g., misconvergence, at a given display screen location. The output of the sensing circuitry 16 is applied to the holding and adjustment fixture 13 which adjusts the position of the deflection yoke 11 in order to decrease the magnitude of the errors determined by the sensing circuitry 16.

In accordance with an aspect of the present invention, the video display system adjustment and assembly arrangement 10 incorporates an adhesive dispensing apparatus 17. Depending on the application of the video display system adjustment and assembly arrangement 10, the adhesive dispensing apparatus 17 may be utilized to affix the coils of the deflection yoke 11 with respect to each other, to attach yoke 11 to the CRT 12, or in combination, to affix the coils of yoke 11 and attach yoke 11 to the CRT 12. The adhesive is a flexible, novel UV-curable adhesive, as described hereinafter, which is cured by exposure to a UV source 18.

Figure 2:
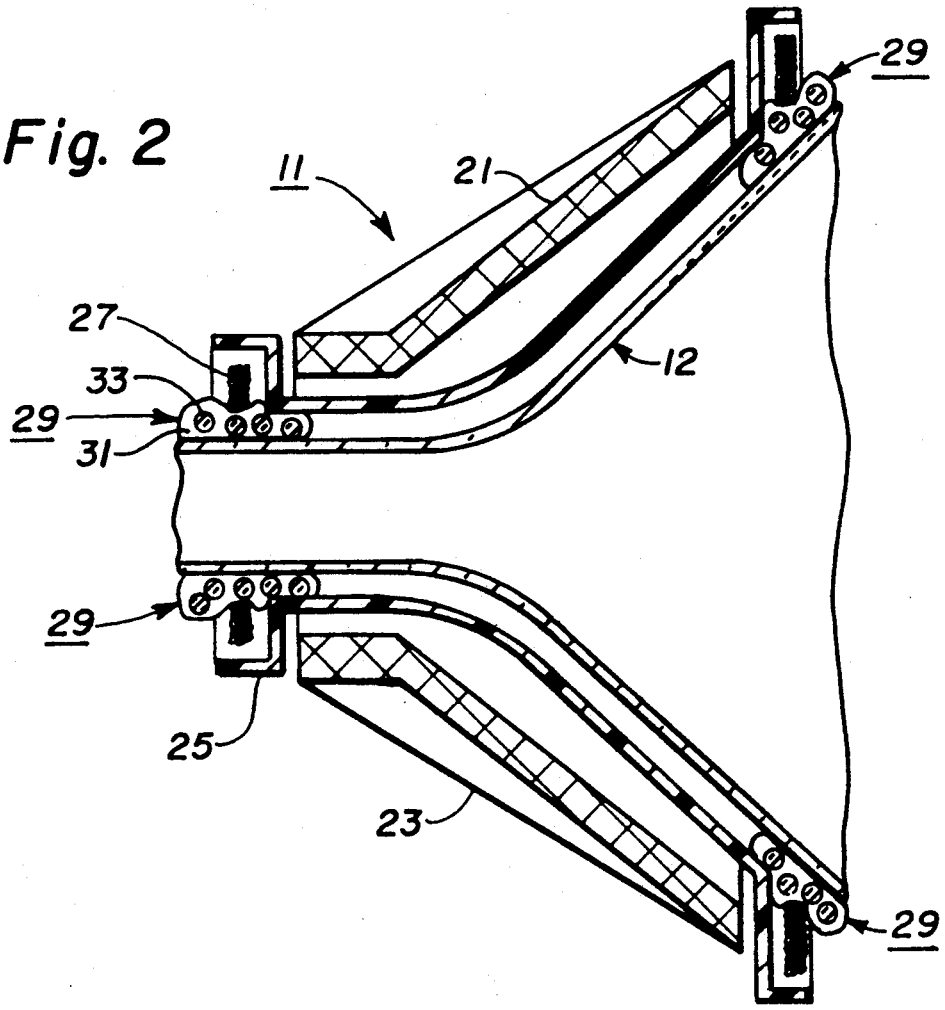
FIG. 2 is a cross-sectional view of a portion of a deflection yoke and CRT attached according to the present invention.

FIG. 2 shows in cross section the deflection yoke 11 in place on the glass envelope of the CRT. The yoke 11 comprises a magnetically permeable core 21 on which are toroidally wound the vertical deflection coils 23. The yoke 11 also incorporates a plastic insulator 25 and saddle-type horizontal deflection coils 27 of which only the end turns are shown. A novel adhesive 29 is illustratively shown in position at various locations in order to attach the yoke 11 to the CRT 12.

The composition of the adhesive 29 is a polymeric material comprising a UV-curable adhesive 31, such as a UV/acetoxy or UV/methoxy curing silicone sealant, mixed with UV transmitting particles 33 of glass or fused quartz in an amount up to 50 wt. % of the composition, although 25 to 50 wt. % is preferred. One example of a suitable UV/acetoxy curing silicone is NUVA-SIL 83, manufactured by Loctite Corp., Newington, Conn. The UV transmitting particles 33 are preferably borosilicate glass spheres ranging in diameter from 0.5 to 2.0 mm. By borosilicate glass is meant a type of glass containing at least 5 wt. % boron oxide. Suitable commercial borosilicate glasses include, but are not limited to 7052, 7720, 7740, 7750 and 7770. Also suitable are 0080 and 9741 glass spheres as well as fused quartz spheres.

In a test of the acceleration in curing provided by the UV transmitting spheres, five test samples were prepared and the curing times were recorded. In each instance a 10 gm. sample was prepared. The control was a 10 gm. "wad"of NUVA-SIL 83 without any UV transmitting spheres added thereto. Each sample was irradiated or illuminated using a high intensity UV lamp with a flexible fluid optic wand. A preferred UV spot cure system is the MODEL SCU 110 manufactured by UVEXS Inc., Mountain View, Calif. The spot cure system can be operated at an output of either 254 nm or 365 nm, the latter being preferred to allow the widest choice of UV transmitting spheres for inclusion in the novel adhesive composition.

To facilitate testing, two size ranges and two different weight ratios of borosilicate glass beads were evaluated. All samples were illuminated with a light having a wavelength of 365 nm and a spot diameter of about 20 mm at a distance of about 30 mm. The test results are summarized in the TABLE.

TABLE

| Sample No. | Adhesive (gm) | Beads (gm) | Bead size (mm) | Cure time (sec) |
|---|---|---|---|---|
| 1 | 10 | 0 | 0 | 200 |
| 2 | 7.5 | 2.5 | 1.5–2.0 | 140 |
| 3 | 5.0 | 5.0 | 1.5–2.0 | 60 |
| 4 | 7.5 | 2.5 | 0.5–0.75 | 160 |
| 5 | 5.0 | 5.0 | 0.5–0.75 | 80 |

It can be seen from the table that the UV-curable adhesive, without any glass filler, cures in 200 seconds. This is an unacceptably long cure time for a production process. The addition of large diameter glass beads ranging in size 1.5 to 2.0 mm accelerates the cure time to an acceptable 140 seconds for a 25 wt. % composition and to a very acceptable 60 seconds for a 50 wt. % composition of large glass beads. The smaller diameter glass beads (0.50 to 0.75 mm) accelerate the cure time over that of the control sample of adhesive but have a 20 second longer cure time than corresponding wt. % samples of the larger diameter glass beads. It is believed that the acceleration in curing is caused by the lensing effect of the glass beads which permit the UV light to effect a rapid deep cure of the UV adhesive. The larger spheres more effectively transmit the UV light within the samples.

The resultant adhesive composition has a slight increase in Shore A hardness over the control sample; however, the final Shore A Durometer reading of 60 to 70 shows that the novel composition is relatively flexible compared to the Shore D Durometer reading of 70–80 for the rigid urethane adhesive system described in the above referenced U.S. Pat. No. 4,616,265. While the coefficient of thermal expansion/oC for the novel UV adhesive composition is about $2.28\times10^{-4}$ and does not match that of the glass envelope of the CRT (about $97.5\times10^{-7}$), the relative flexibility of the novel adhesive composition and the fact that it will not spall glass prevent mechanical damage to the glass envelope that was characteristic of the adhesive described in U.S. Pat. No. 4,616,265. The present novel adhesive also permits replacement and salvage of the yoke, because in the present method the adhesive is applied only adjacent to the ends of the yoke where it can be removed conventionally such as by cutting or equivalent mechanical means.

What is claimed is:

1. In a combination including a cathode-ray tube having a glass envelope, a deflection yoke positioned on said envelope for producing a magnetic field, and a body of cured polymeric material attaching said yoke in a fixed position on said envelope, the improvement wherein said body of polymeric material comprises a composition including a UV curable adhesive and UV-transmissive particles of a suitable material in an amount sufficient to accelerate the curing of said adhesive.

2. The cathode-ray tube-yoke combination defined in claim 1 wherein said particles comprise up to 50 wt. % of said composition.

3. The cathode-ray tube-yoke combination defined in claim 2 wherein said particles comprise spheres ranging in diameter from 0.5 to 2.0 mm.

4. The cathode-ray tube-yoke combination defined in claim 3 wherein said spheres comprise 25 to 50 wt. % of said composition.

5. The cathode-ray tube-yoke combination defined in claim 4 wherein said spheres range in diameter from 1.5 to 2.0 mm.

6. The cathode-ray tube-yoke composition as defined in claim 5 wherein said spheres comprise 50 wt. % of said composition.

7. The cathode-ray tube-yoke combination defined in claim 4 wherein said spheres comprise UV-transmissive glass beads.

8. The cathode-ray tube-yoke combination defined in claim 7, wherein said glass beads are selected from the group consisting of 0080, 7052, 7720, 7740, 7750, 7770 and 9741 glass.

9. The cathode-ray tube-yoke combination as defined in claim 4 wherein said spheres comprise fused quartz.

10. The cathode-ray tube-yoke combination defined in claim 1 wherein said composition has a Shore A hardness within the range of 60 to 70.

11. A method for attaching a deflection yoke to a cathode-ray tube comprising the steps of:

placing said deflection yoke in a desired position on a glass envelope of said cathode-ray tube using position means;

dispensing a body of polymeric material to attach said yoke on said envelope, said body of polymeric material comprising a composition including a UV-curable adhesive and UV-transmissive particles of a suitable material in an amount sufficient to accelerate the curing of said adhesive; and illuminating said composition with UV light.

* * * * *

UNITED STATES PATENT AND TRADEMARK OFFICE
CERTIFICATE OF CORRECTION

PATENT NO. : 5,019,745

DATED : May 28, 1991

INVENTOR(S) : Samuel B. Deal et al.

It is certified that error appears in the above-identified patent and that said Letters Patent is hereby corrected as shown below:

Col. 1, line 60, before "overcomes" delete "to".

Col. 3, line 62, after "size" add --from--.

Col. 4, line 14, change "oC" to --°C--.

Col. 4, line 24, after "method" add --,--.

Signed and Sealed this

Twenty-ninth Day of September, 1992

*Attest:*

DOUGLAS B. COMER

*Attesting Officer*

*Acting Commissioner of Patents and Trademarks*